US005333929A

United States Patent [19]

Slagerman

[11] Patent Number: 5,333,929

[45] Date of Patent: Aug. 2, 1994

[54] WHEELCHAIR TRAY

[75] Inventor: Gordon L. Slagerman, Rosser, Canada

[73] Assignee: Slagerman Engineering Ltd., Rosser, Canada

[21] Appl. No.: 889,935

[22] Filed: Jun. 2, 1992

[51] Int. Cl.[5] ..... A47B 83/02

[52] U.S. Cl. ..... 297/155; 297/162

[58] Field of Search ..... 297/160, 162, 155, 154, 297/145, 153

[56] References Cited

U.S. PATENT DOCUMENTS

| | | | |
|---|---|---|---|
| 975,755 | 11/1910 | Eyles | 297/155 X |
| 1,060,503 | 4/1913 | Schmucker | 297/155 |
| 1,670,603 | 5/1928 | Weeks | 297/155 X |
| 2,900,011 | 8/1959 | Casey | 297/155 X |
| 3,020,085 | 2/1962 | Russell . | |
| 3,142,511 | 7/1964 | Rehel . | |
| 3,338,627 | 8/1967 | Frank . | |
| 3,515,429 | 6/1970 | Bollinger . | |
| 3,606,450 | 9/1971 | Sedgwick . | |
| 3,870,362 | 3/1975 | Large | 297/155 |
| 3,915,102 | 10/1975 | Barron . | |
| 3,987,994 | 10/1976 | Frankford . | |
| 4,054,315 | 10/1977 | Czarnowski . | |
| 4,081,198 | 3/1978 | Penney . | |
| 4,364,699 | 12/1982 | Koppes . | |
| 4,373,756 | 2/1983 | Purdy et al. . | |
| 4,436,339 | 3/1984 | Albers . | |
| 4,526,419 | 7/1985 | Bowman et al. . | |
| 4,566,732 | 1/1986 | Ostergaard, II et al. . | |
| 4,632,451 | 12/1986 | Lee . | |
| 4,685,726 | 8/1987 | Wolpert | 297/155 X |
| 4,779,884 | 10/1988 | Minati . | |
| 4,848,833 | 7/1989 | Grall . | |
| 5,139,309 | 8/1992 | Kornretch | 297/162 X |

FOREIGN PATENT DOCUMENTS

| | | | |
|---|---|---|---|
| 314157 | 8/1931 | Canada . | |
| 1107630 | 8/1981 | Canada . | |
| 1156948 | 11/1983 | Canada . | |
| 1265733 | 2/1990 | Canada . | |
| 1281060 | 3/1991 | Canada . | |
| 2004520 | 6/1991 | Canada . | |
| 755261 | 11/1933 | France | 297/155 |
| 80967 | 2/1956 | Netherlands | 297/160 |
| 12376 | 3/1909 | United Kingdom | 297/155 |

*Primary Examiner*—Peter M. Cuomo
*Assistant Examiner*—Jerry Redman
*Attorney, Agent, or Firm*—Murray E. Thrift; Adrian D. Battison; Stanley G. Ade

[57] ABSTRACT

A table assembly is mounted on a wheelchair using a hinge mounted along the side of the chair arm. The table assembly has a panel with two use positions, one extending across the front of the chair and the other extending laterally to the side of the chair. The table panel may be stowed in a position alongside the chair, inside the brake and the drive wheel, beneath the arm. It is readily removed and replaced.

16 Claims, 14 Drawing Sheets

WHEELCHAIR TRAY

FIELD OF THE INVENTION

The present invention relates to wheelchair tables and more particularly to a self-storing table assembly for a wheelchair.

BACKGROUND

Various wheelchair tables and trays have been proposed. These proposals include the table assembly of Groll, U.S. Pat. No. 4,848,833, issued July 18, 1989. The Groll device provides a complex double pivot and slide arrangement allowing a table to be stored at the side of the chair or used in a position extending across the front of the chair. The double pivot and slide system for this table is undesirably complex. The double pivot must be positioned, for space reasons, in front of the arm rest, so that the table projects to the front of the chair when stored. This limits access to the chair.

Another self-storing table is described in Minati U.S. Pat. No. 4,779,884, issued October 25, 1988. The Minati table is mounted on the chair using a clamp on one of the vertical standards at the front of the chair and a mounting bracket projecting laterally outwardly and then upwardly from the clamp. At the top of the mounting bracket, the table itself is mounted using a sliding pivot. The table folds in half and stores in a vertical position at the side of the chair. In the stored position, the table projects to the front of the chair and is positioned some distance from the side of the chair proper. This appears to be necessary in order to clear the drive wheel and brake on the table side of the chair.

The objective of the present invention is to provide a simple, effective table assembly for a wheelchair.

SUMMARY

According to the present invention there is provided in a wheelchair having a chair in at least one substantially horizontal arm and drive wheels on opposite sides of the chair, a table assembly comprising:

first hinge means mounted on the chair arm and having first hinge pivot means extending along an outer side of the arm;

a table panel having opposite first and second faces and a mounting edge;

second hinge means including table panel mounting means secured to the table panel adjacent the mounting edge thereof, second hinge pivot means with a pivot axis spaced outwardly from the mounting edge and spaced from the second face of the panel, the second pivot means engaging the first pivot means for pivotal movement of the table panel between a first use position extending across the arm with the first face of the table panel uppermost and a storage position substantially below the arm, laterally between the chair and the adjacent drive wheel.

The offsetting the pivot axis outwardly and to the "bottom" side (in use) of the table panel, and the mounting of the hinge directly on the outside of the arm allows the table panel to be positioned above and across the arm in the use position and stowed against the side of the chair, inside the drive wheel and the usual brake mechanism.

In order to limit the forwards projection of the table in the stored position, and to provide for adjustment of the table in the use position, the hinge preferably has a sliding action. This allows the table panel to slide along the side and the chair, inside the brake of the drive wheel when pivoted to the stored position. It also allows a similar fore and aft sliding of the panel in the use position.

It is preferred that the hinge be constructed to support the table in a second use position projecting outwardly from the chair arm. This provides considerable added flexibility as a supporting surface is available while access to the chair is not limited.

The hinge may be mounted on the arm of the chair using a clamp that will engage the arm tube of an existing chair without modification, and on most common sizes of arm tube. This is achieved using a clamp with a multiple radius arcuate face. The hinge may be constructed to mount an original arm rest without modification in order to preserve the appearance and comfort of the chair.

The preferred hinge construction allows the table panel to be removed from and reinstalled on the chair quickly and easily.

BRIEF DESCRIPTION OF THE DRAWINGS

In the accompanying drawings, which illustrate an embodiment of the invention.

DETAILED DESCRIPTION

Figure 1:
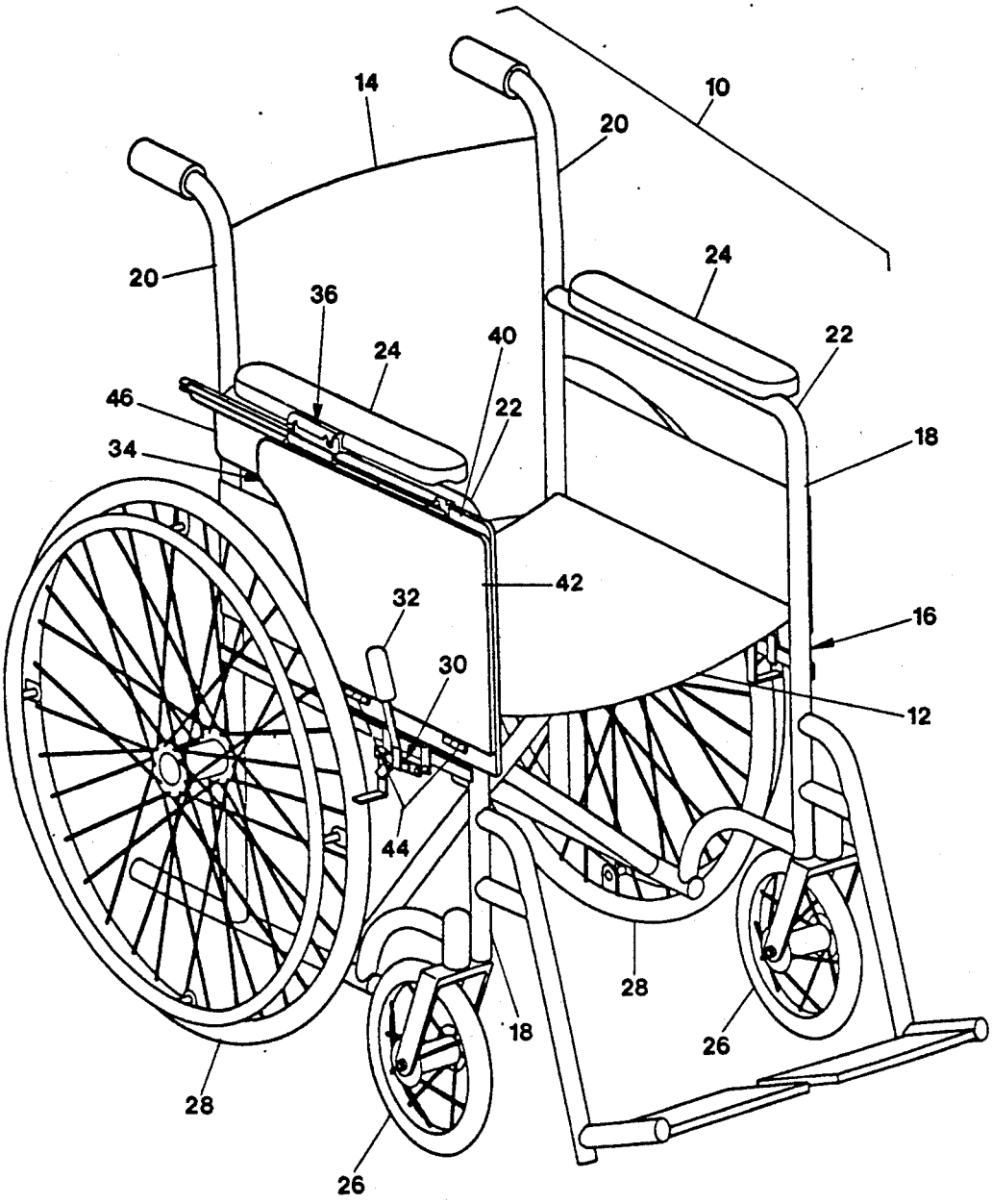
FIG. 1 is an axonometric representation of a chair with a table in the stored position.

Referring to the accompanying drawings, there is illustrated a wheelchair 10 with a seat 12 and a back 14 mounted on a tubular metal frame 16. The frame includes two front standards 18, two back standards 20 and a pair of arms 22 that are horizontal extensions of the front standards to the back standards. Each arm carries an arm rest 24.

The front of the chair is supported on two caster wheels 26, while two large diameter drive wheels 28 support the rear of the chair. Each drive wheel may be locked using a brake 30 mounted on the side of the chair and actuated by a brake lever 32. The chair is of a conventional construction.

A table 34 is mounted on the chair, on the right hand side, by a hinge 36 extending along the outer side of the right hand arm 22. The table slides on the hinge between a rear stored position shown in FIG. 1, where the table is positioned almost entirely behind the adjacent front standard 18 and a forwards position illustrated in FIG. 2 where a concave rear edge 38 of the table is positioned in front of the brake lever 32 and the adjacent drive wheel 28.

Figure 2:
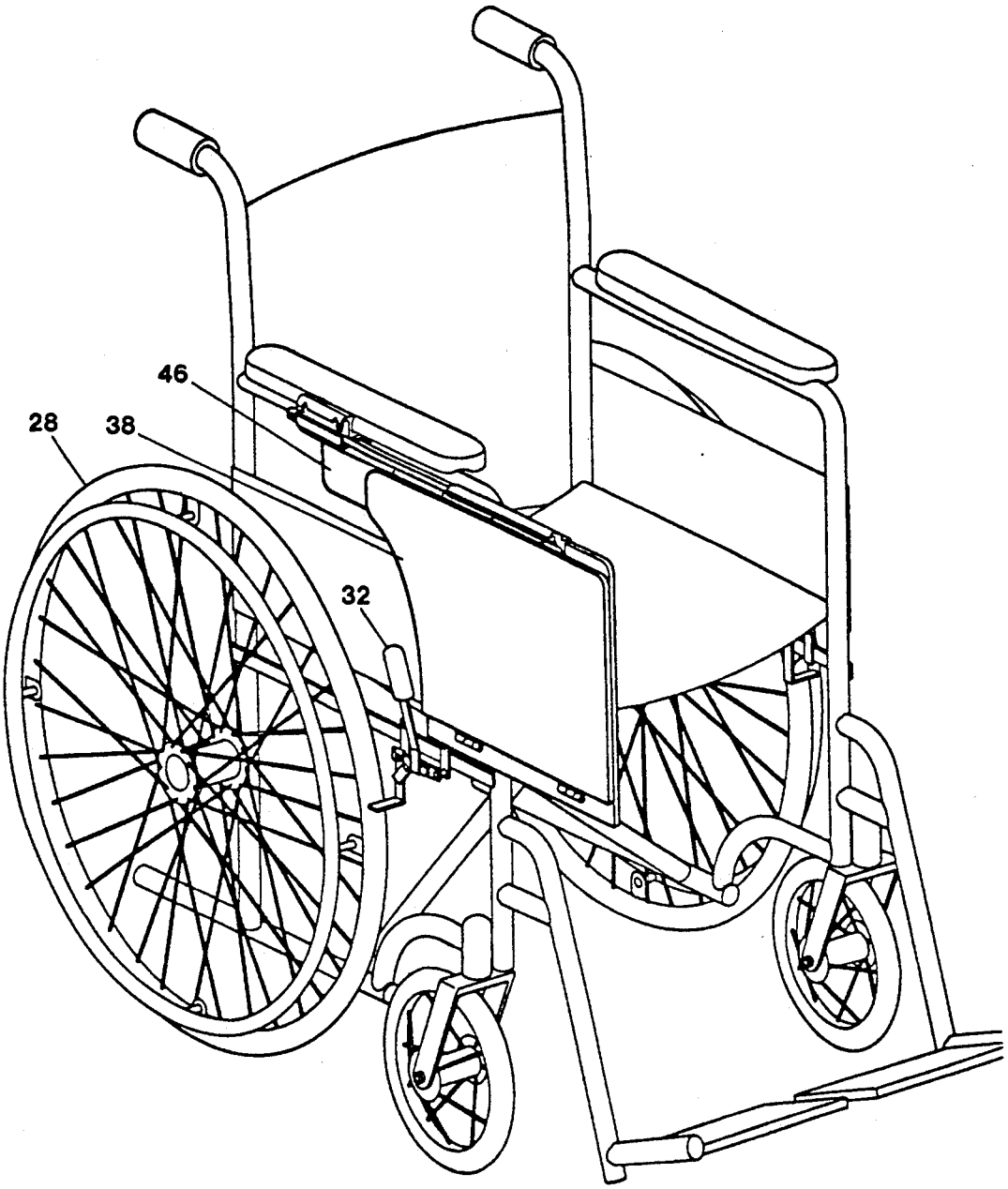
FIG. 2 is a view like FIG. 1 with the table moved forwardly.
Figure 3:
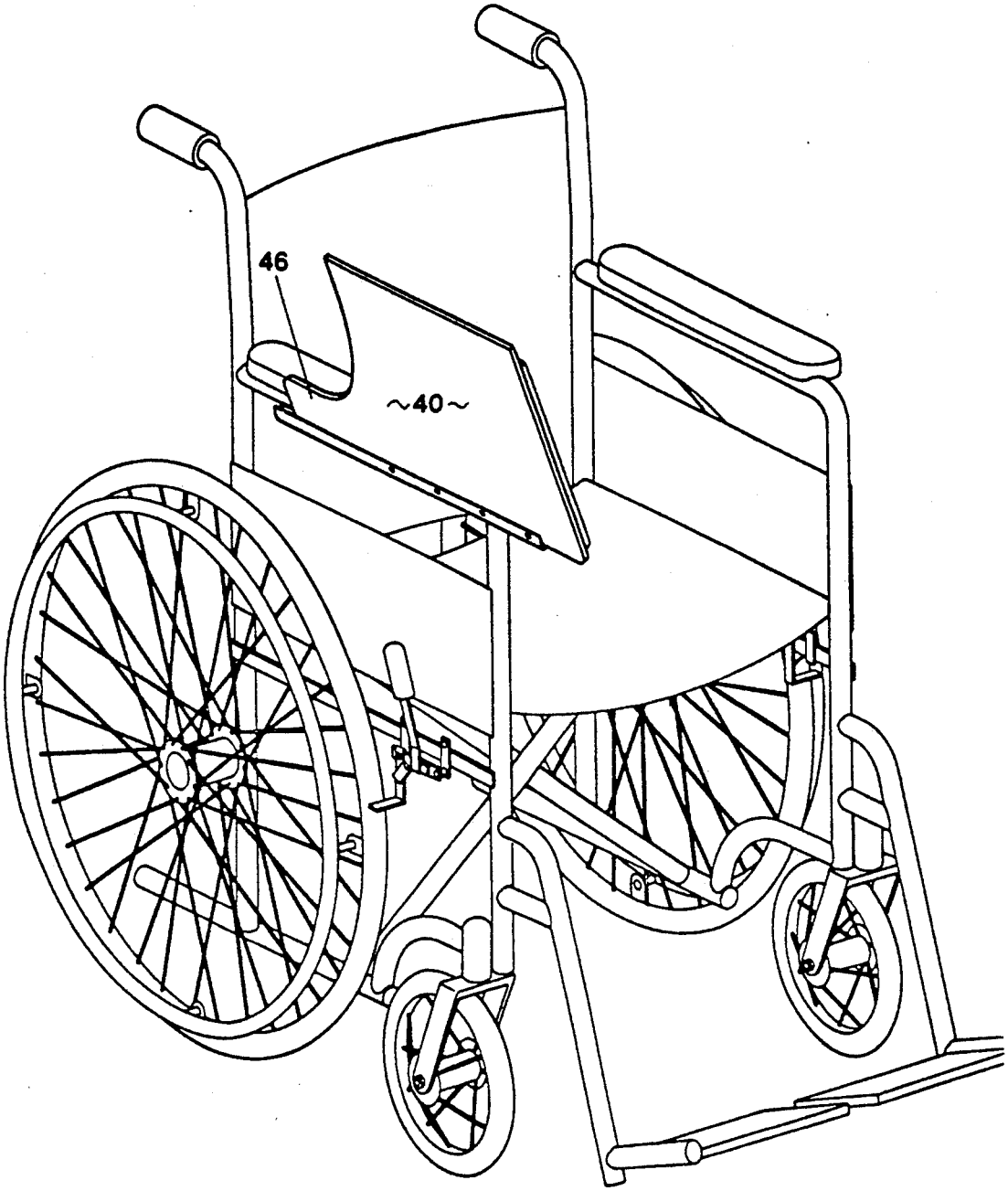
FIG. 3 is a view like FIG. 1 with the table partially raised.
Figure 5:
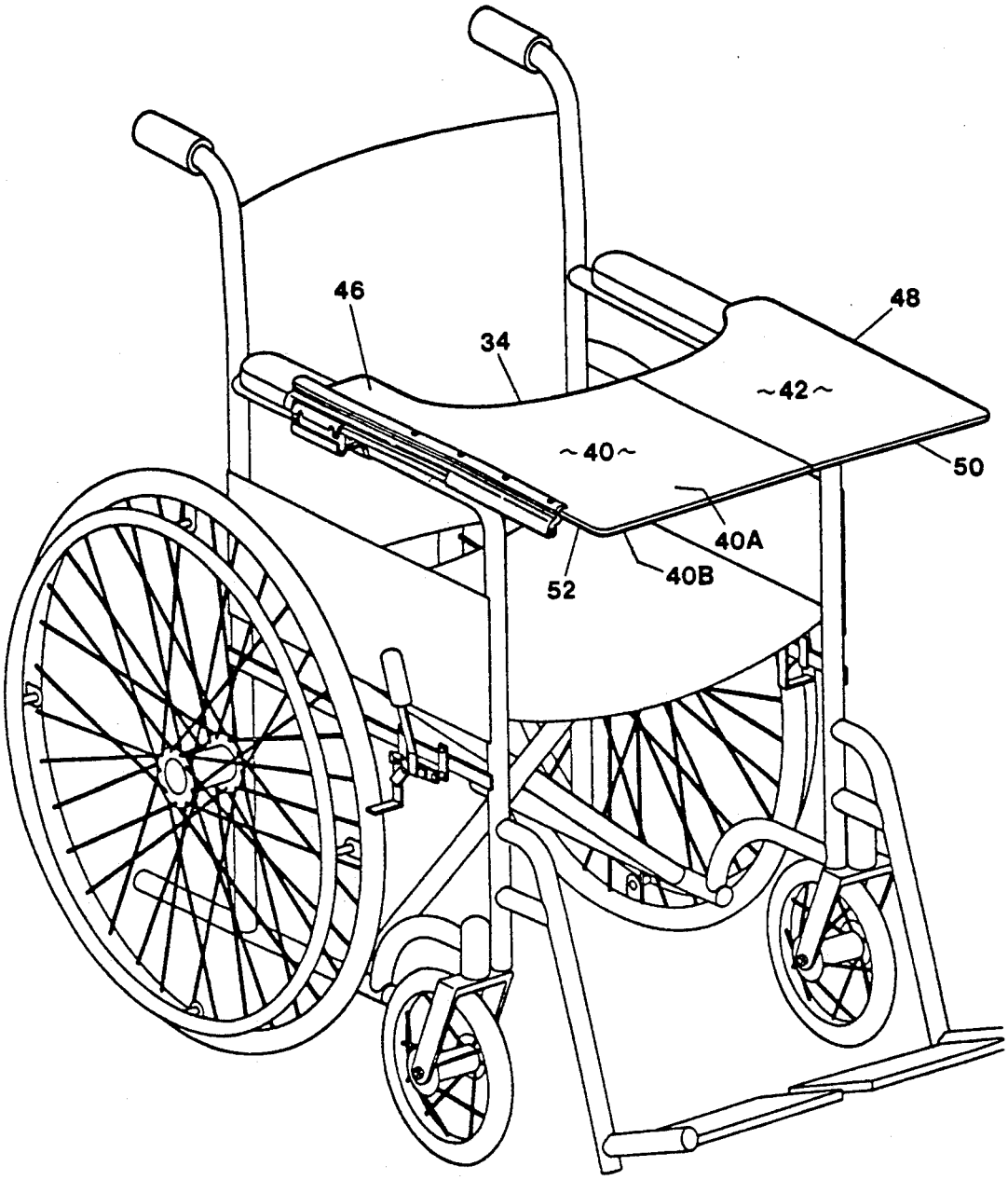
FIG. 5 is a view like FIG. 1 with the table fully unfolded across the chair.

The table is composed of two panels, a panel 40 fastened to the hinge 36 and a panel 42 connected to the panel 40 by hinges 44. The hinge arrangement is such that the table panels will unfold to coplaner condition as illustrated in FIG. 5 or collapsed to a superimposed condition as illustrated in FIGS. 1, 2 and 3. The table panel 40 has an extension 46 which projects to the rear adjacent the hinge. In the extended condition shown in FIG. 5, the table has a straight side edge 48 on the side of the chair opposite the hinge 36. A front edge 50 extends across the front of the table while a mounting edge 52 of the table panel 40 is secured to the hinge.

Figure 4:
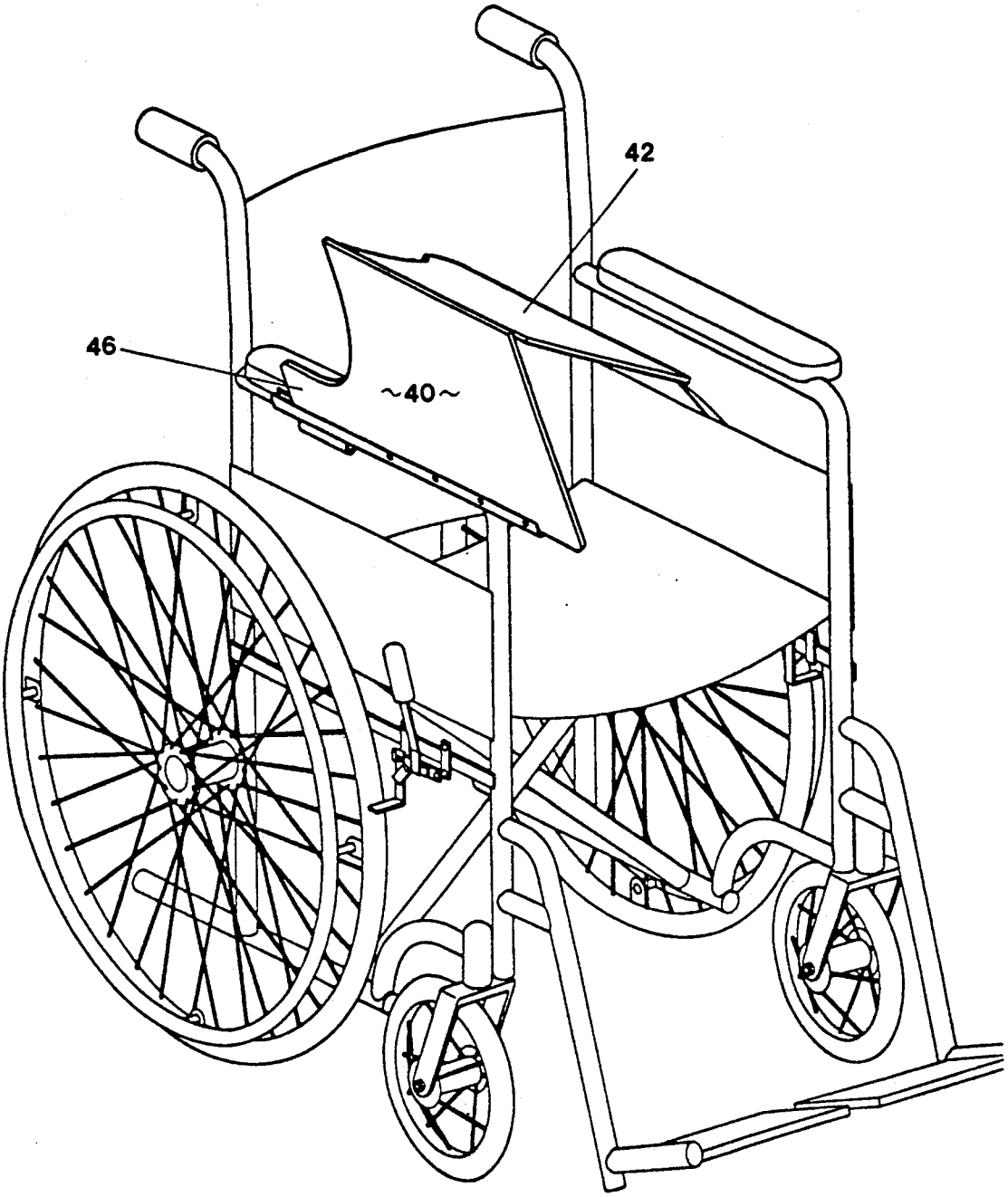
FIG. 4 is a view like FIG. 1 with the table partially unfolded across the chair.
Figure 6:
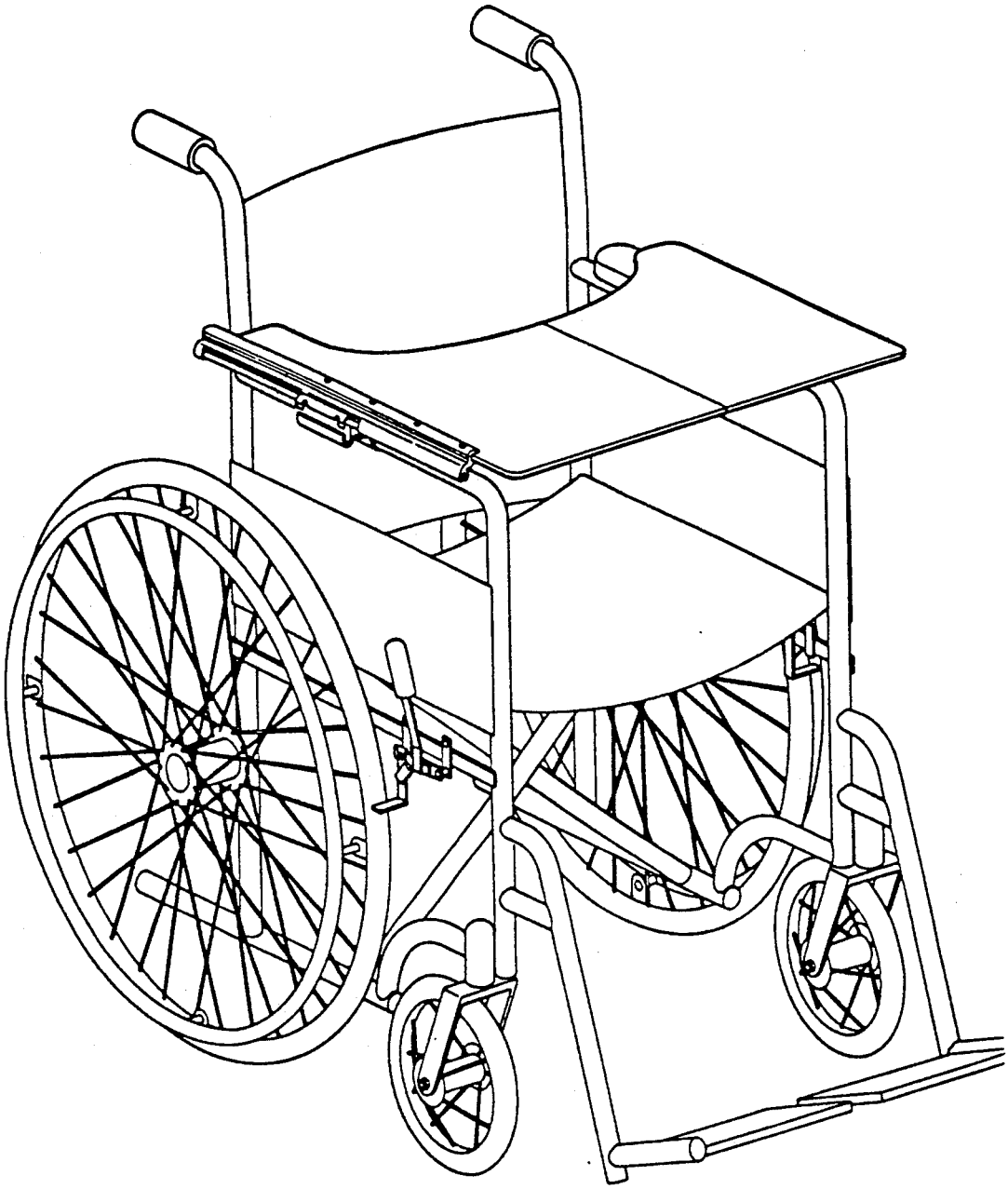
FIG. 6 is a view like FIG. 5 with the table moved towards the chair back.

The stored condition of the table is illustrated in FIG. 1. To put the table into use from that condition, the table panels are slid forward to the position illustrated in FIG. 2. From that position, the table panels are pivoted upwardly and unfolded as illustrated in FIGS. 3 and 4 and then extended fully across the chair as illustrated in FIG. 5. In FIG. 5, the table panels are in a fully forward position. They may be drawn back towards the occupant of the chair as illustrated in FIG. 6.

Figure 7:
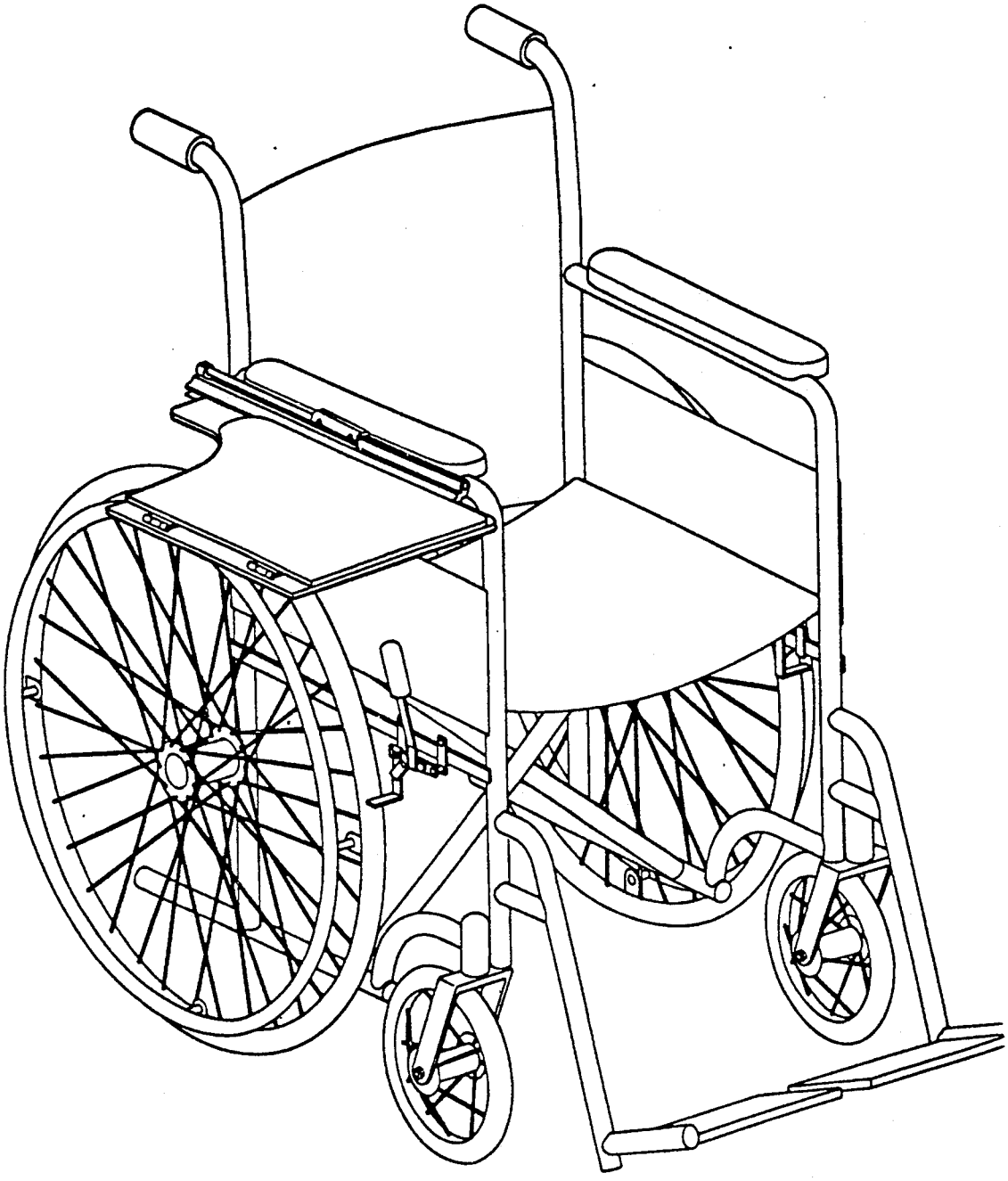
FIG. 7 is a view like FIG. 1 with the table in a second use position.

A second use position of the table is illustrated in FIG. 7 where the table panels are shown superimposed and projecting horizontally outwardly from the right hand arm of the chair so that the front of the chair will be accessible, while still providing a table for supporting objects.

Figure 8:
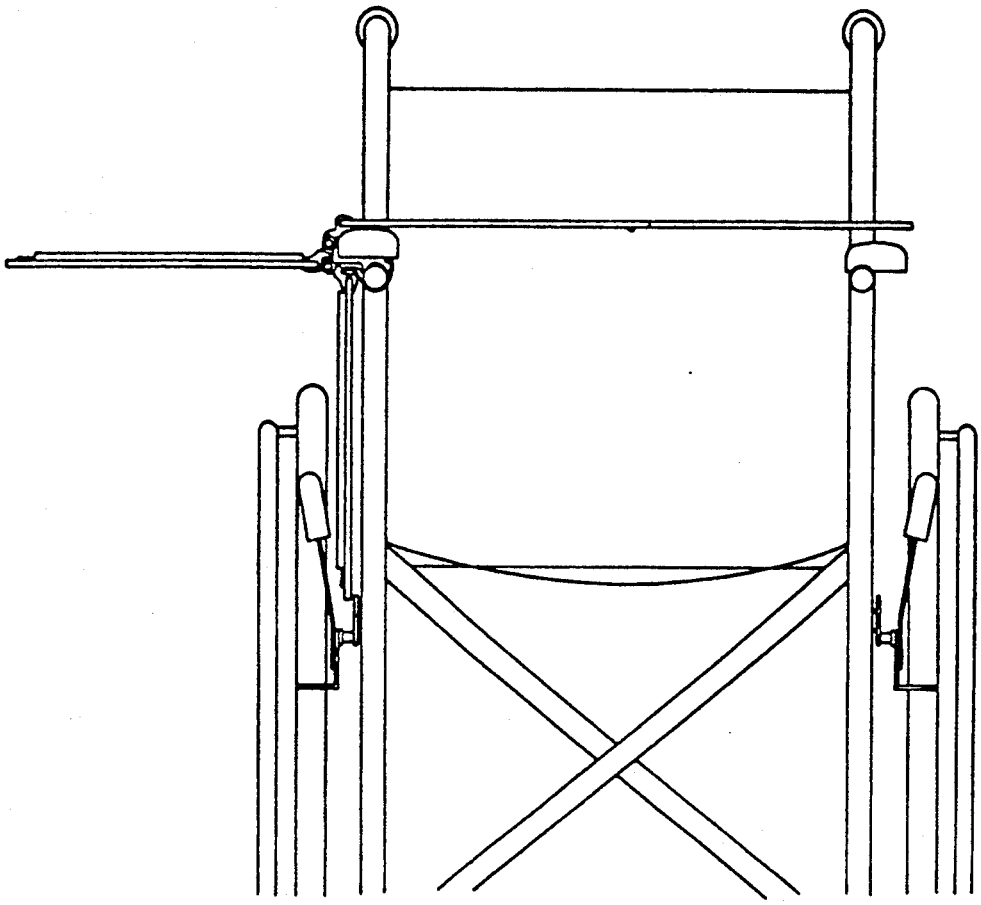
FIG. 8 is a front view of the chair showing the three positions of the table.

FIG. 8 illustrates the three positions of the table: the folded, stored position at the side of the chair, below the arm; the first use position extending across the chair and the second use position projecting outwardly from the chair arm.

Figure 9:
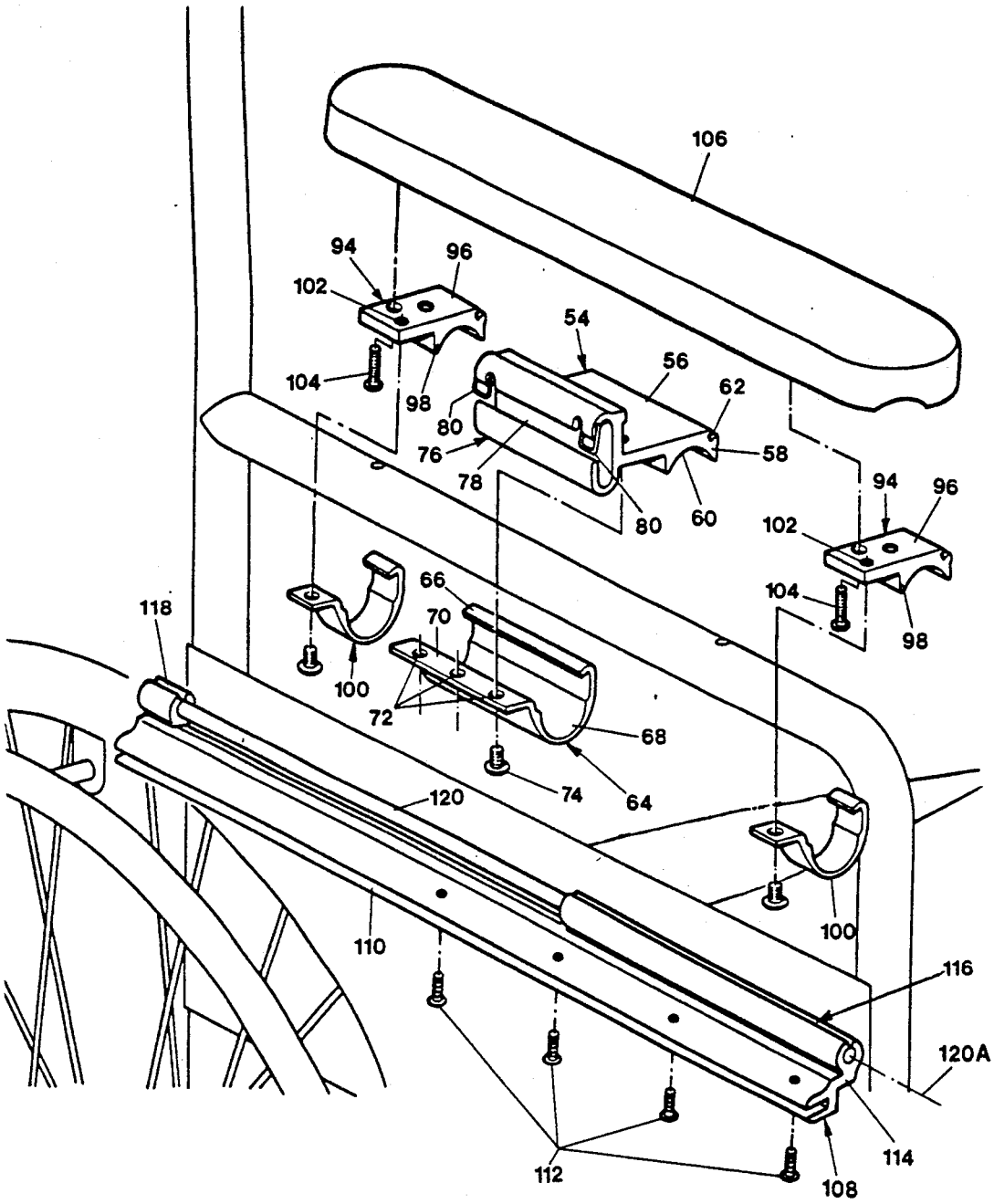
FIG. 9 is an isometric exploded view illustrating the hinge components.
Figure 10:
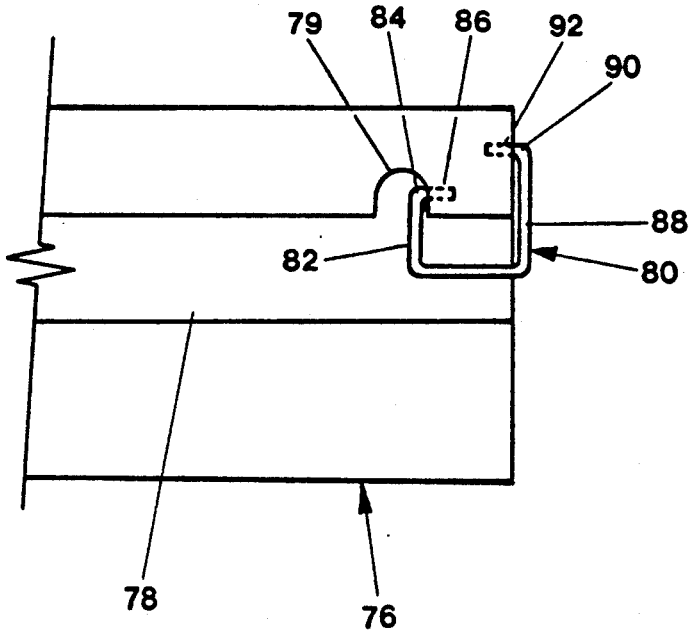
FIG. 10 is a detail of the fixed hinge component.

The table mounting hinge is illustrated most particularly in FIG. 9. As illustrated in that figure, the table includes a fixed hinge component 54 to be mounted on the tubular arm 22 of the chair. This hinge component includes a flange 56 carrying a mounting block 58 on its bottom face. The mounting block has an arcuate clamping face 60 to engage the top of the arm 22. A downwardly sloping slot 62 extends along the upper and inner comer of the flange. The hinge component also includes a clamp arm 64 that is generally arcuate in shape. It has an edge flange 66 that engages in the slot 62 and an upwardly concave actuate clamping face 68. Flange 70 projects outwardly from the clamp arm along the side opposite the flange 66. It is provided with screw holes 72 that accommodate screws 74 passing through the flange into threaded bores in the flange 56.

A channel 76 extends along the outer edge of the flange 56. It has a vertically elongate shape in profile and a horizontal slot 78 along its outer side. Two notches 79 are formed in the upper edge of the slot adjacent the opposite ends of the channel. These are used to accommodate two wire loops 80 that extended partially across the slot to restrict free passage through the slot. Each wire loop has a short arm 82 with an end 84 extending at a right angle from the arm and seated in a horizontal bore 86 in the side face of the associated notch 79. Each wire loop also has a long arm 88 at the end of the channel with end section 90 that extends at right angles into a bore 92 in the end of the channel. The bores 86 and 92 are offset from one another by an amount equal to the difference in length of the two arms 82 and 88 so that the loop will not pivot freely about a single axis. Instead, the loop may be deflected resiliently into or out of the slot 78 to provide some resistance to passage of an object through the slot.

The arm 22 also carries two arm rest brackets 94. Each of these includes a flange 96 with a mounting block 98 that corresponds in configuration to the flange 56 and mounting block 58 of the hinge component 54. Each bracket also includes a clamp arm 100 that corresponds in configuration to the clamp arm 64 of the hinge. The flanges 96 of the brackets have through holes 102 that receive screws 104 for mounting an arm rest 106.

The arm rest 106 is configured to be mounted on the arm 22 with a pair of screws through aligned holes in the arm and into threaded bores in the arm rest. With the brackets 94, the screws 104 thread into the existing arm rest mounting holes. As can be seen most particularly from FIGS. 11 through 17, the arm rest is reversed to accommodate this mounting but its positioning relative to the arm remains essentially the same.

The hinge 36 includes a second component 108. This component includes a mounting channel 110 that seats on the mounting edge 52 of the table panel 40. The channel is held in place using a series of screws 112. An offset panel 114 projects from the mounting channel, to one side of the table panel 40 and beyond its mounting edge 52. The offset carries a partial sleeve 116 extending from a front end of the hinge component approximately half way towards the back end. A short sleeve section 118 aligned with the sleeve 116 is located at the rear end of the hinge component. The sleeve components carry a shaft in the form of rod 120 that serves as a pivot rod engageable in the channel of hinge component 54.

Figure 11:
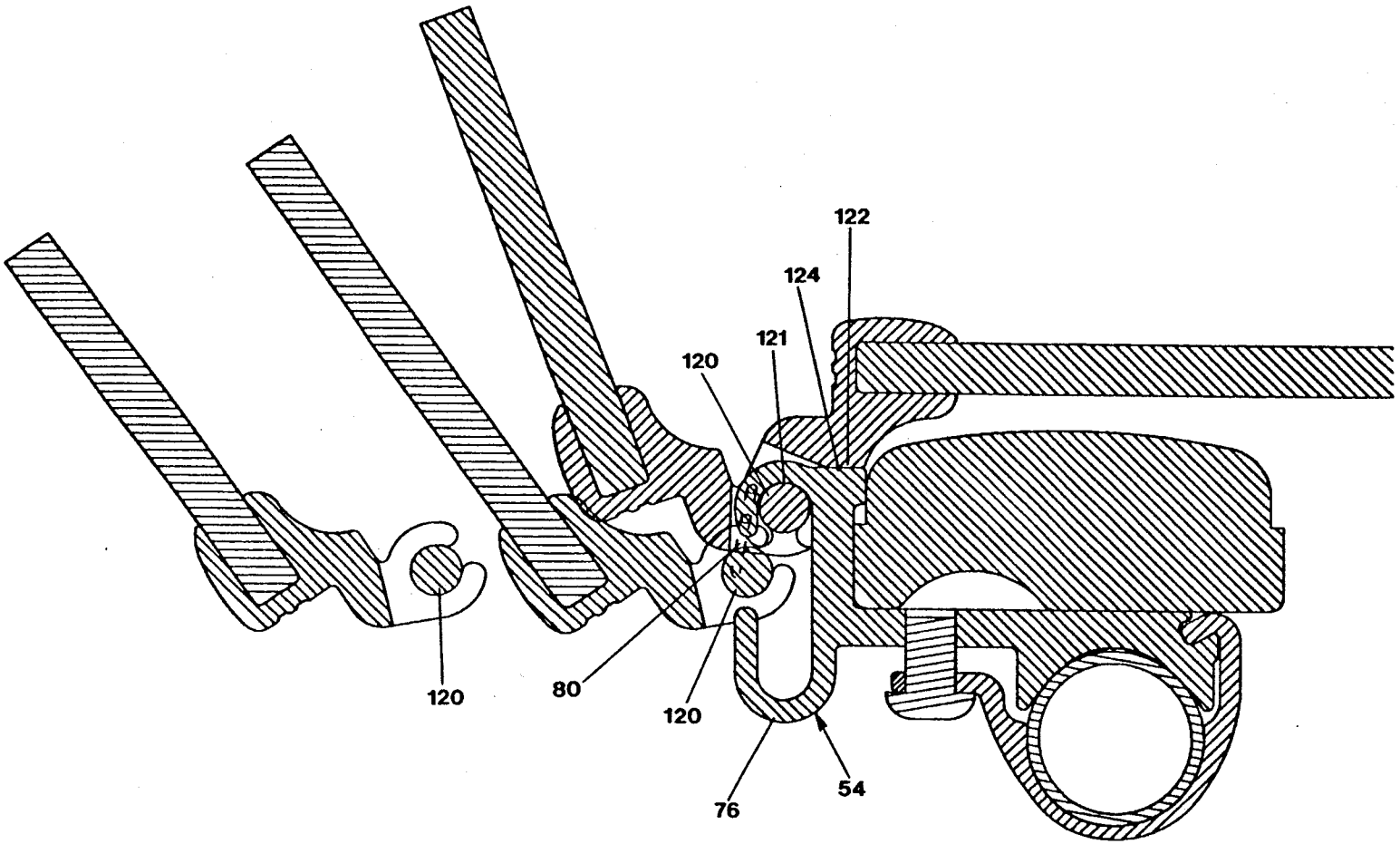
FIG. 11 is a sectional view showing the mounting and removal of the table.

As illustrated most particularly in FIG. 11, the table is mounted on the hinge component 54 by inserting the exposed portion of the rod 120 through the channel slot 78, deflecting the wire loops 80. Once in place, the rod may be seated against an upper concave bearing surface 121 in the channel 76 and the table panels positioned across the arm in the first use position. An abutment face 122 on the offset 114 of the hinge component 108 engages an abutment face 124 of the channel 76 to support the table in the horizontal orientation as shown in FIG. 11.

Figure 12:
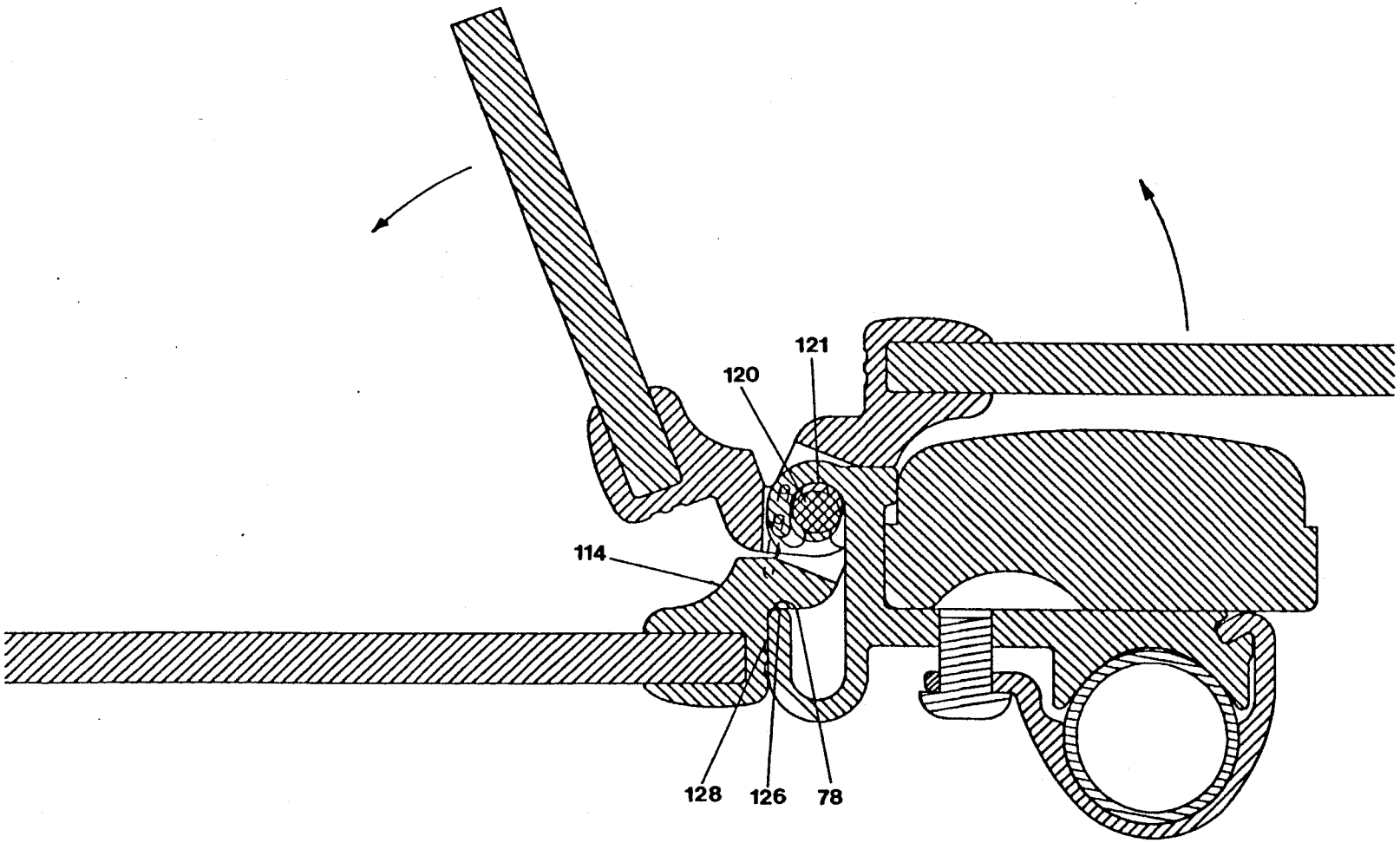
FIG. 12 is a view like FIG. 11 showing the movement of the table between the use positions.

As illustrated in FIG. 12, the table may be moved to the second use position by pivoting the panels outwardly with the rod 120 in engagement with the upper bearing surface 121. The offset 114 of the hinge component 108 then enters the slot 78. An abutment face 126 of the offset then engages the bottom edge of the slot and an abutment 128 forming the end face of the mounting channel 110 engages the outer face of the channel 76 below the slot. The engagement of these faces supports the table in the second use position.

Figure 13:
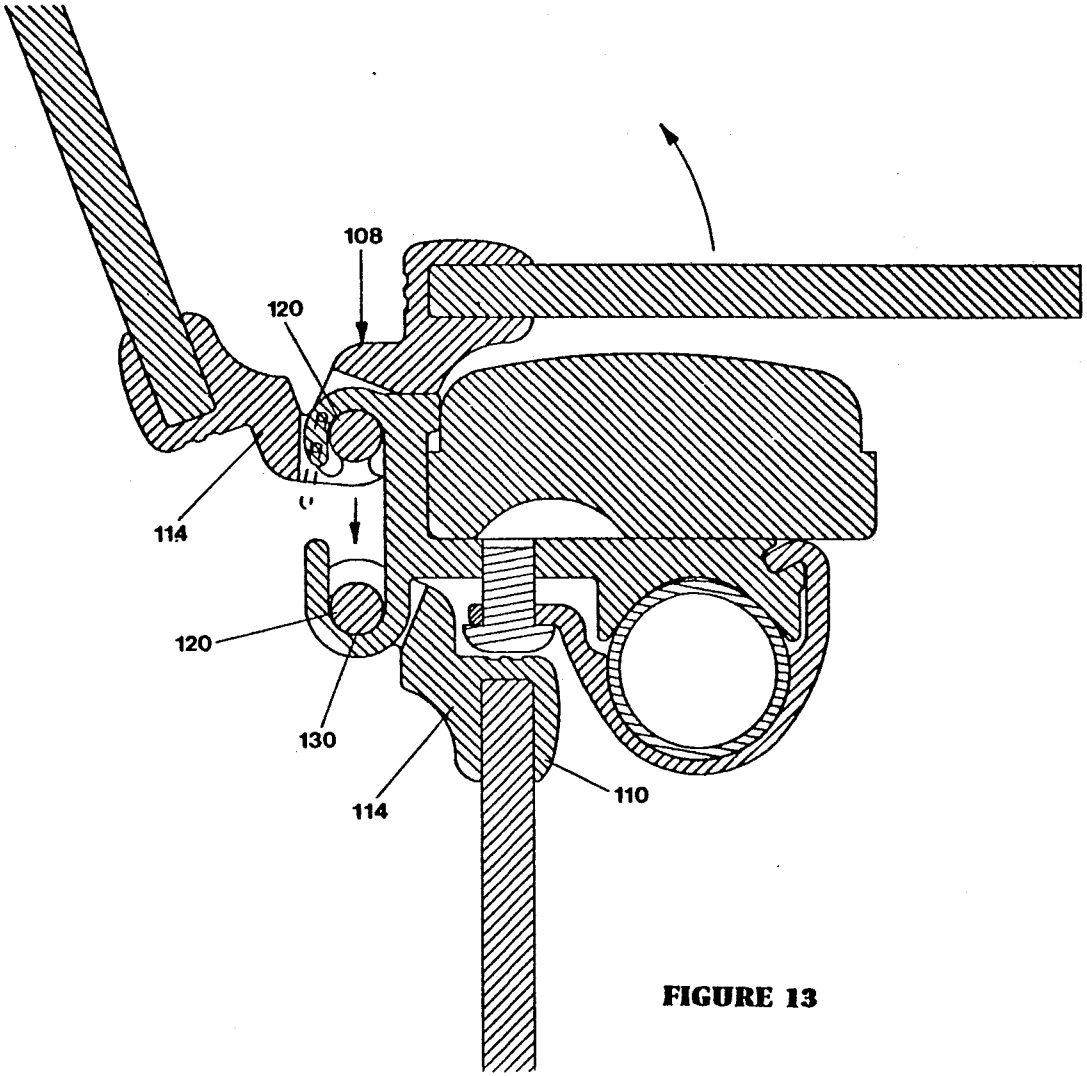
FIG. 13 is a view like FIG. 12 showing the movement of the table between the first in use position and the stored position.

As illustrated in FIG. 13, the table may be moved to the stored position by pivoting the table panels and the hinge component 108 until the offset 114 clears the top of the channel 76. At that time, the rod 120 may move down in the channel 76 to engage a lower bearing surface 130 at the bottom of the channel. The hinge component 108 may then be pivoted further to bring the offset 114 into a position where it extends inwardly from the rod 120 and the mounting channel 110 is positioned beneath the arm rest.

To allow the table assembly to be mounted on chairs having frames in different sizes, the clamping face 60 of the mounting block 58 is formed with sections of increasing radius from the center outwards. The center section 132 has a profile matching a circular profile 134, while two intermediate sections 136 on either side of the center section 132 match a larger circular profile 138. Two outer sections at the edges of the face 60 match the largest circular profile 142.

Figure 15:
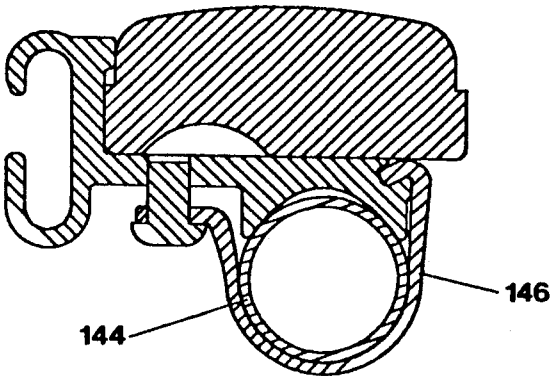
FIGS. 15 through 17 illustrate the hinge clamped to tubes of different sizes.
Figure 17:
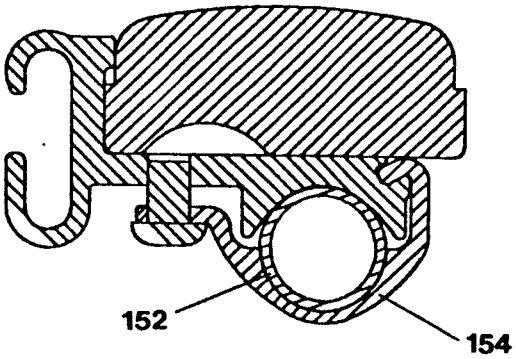
Figure 14:
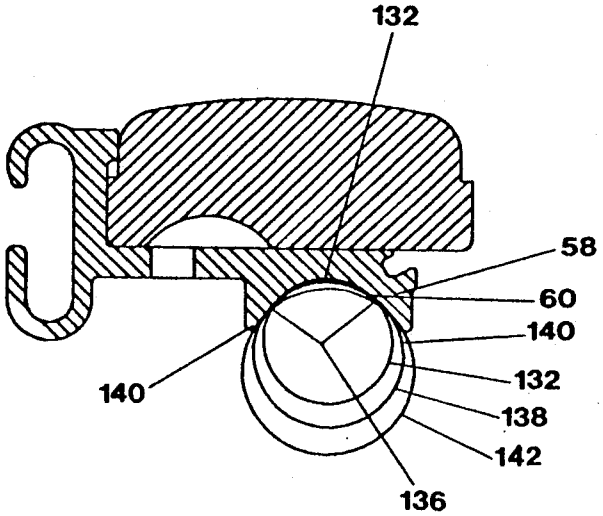
FIG. 14 is a sectional view showing the configuration of the hinge clamp face that accommodates arm tubes of different sizes.
Figure 16:
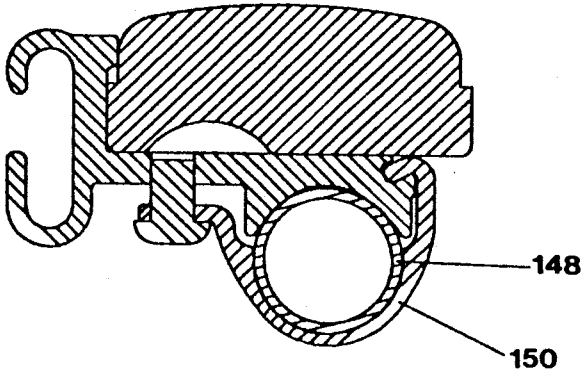

FIG. 15 illustrates the mounting hinge on a large diameter tube 144 using a clamp arm 146. FIG. 16 illustrates the mounting of the hinge on a smaller diameter tube 148 using a clamp arm 150 that matches the tube configuration. FIG. 17 illustrates the mounting of the hinge on a small diameter tube 152 using a third clamp arm 154.

As will be observed from FIGS. 15, 16 and 17, the hinge may be mounted on a wide range of tube sizes, with the only change in the hinge being the configuration of the clamp arm.

The table assembly of the present invention has a very simple mounting system that may be mounted on almost any commercially available wheelchair. It allows the table to be stored completely away, without interfering with the brake or drive wheel of the wheelchair and also provides for two use positions, projecting across the front of the chair and the other projecting laterally from the side of the arm.

While one embodiment of the present invention has been described in the foregoing it is to be understood that other embodiments are possible within the scope of the invention.

Thus, for example, a single panel table may be provided where desired. A single panel arrangement will normally extend only part way across the chair. Additional support may be provided with a second fixed hinge component supporting the rod 120 in front of the component 54, through a gap along the sleeve 116. The invention is to be considered limited solely on the scope of the appended claims.

I claim:

1. In combination, a wheelchair having a chair, at least one substantially horizontal arm and drive wheels on opposite sides of the chair, and a table assembly, the table assembly comprising:

first hinge means mounted on the arm and extending along an outer side of the arm;

a table panel having opposite first and second faces and a mounting edge;

second hinge means secured to the table panel adjacent the mounting edge of the table panel and having a pivot axis spaced outwardly from the mounting edge, the pivot axis being offset from the table panel so as to be spaced from the second face of the table panel, the second hinge means pivotably and slidably engaging the first hinge means for pivotal movement of the table panel about the pivot axis and for translation of the table along the pivot axis whereby the table panel may move between a first use position extending across the arm with the first face of the table panel uppermost and a storage position substantially below the arm, laterally between the chair and the adjacent drive wheel.

2. A wheelchair according to claim 1 including abutment means on the first and second hinge means, engageable in the first use position to support the table panel in the first use position.

3. A wheelchair according to claim 2 wherein the first hinge means comprise an upper bearing means engageable with the second hinge means in the first use position of the table panel and a lower bearing means below the upper bearing means engageable with the second hinge means in the storage position of the table panel.

4. A wheelchair according to claim 3 including second abutment means on the first and second hinge means, engageable in a second use position of the table panel, in which the table panel projects substantially horizontally outwardly from the arm and the second hinge means engages the upper bearing means for supporting the table panel in the second use position.

5. A wheelchair according to claim 4 wherein the first hinge means comprise a channel extending along the arm and the second hinge means comprise an elongate shaft engageable in the channel.

6. A wheelchair according to claim 5 wherein the shaft is rotable in the channel and slideable therealong.

7. A wheelchair according to claim 1 comprising first and second table panels and table hinge means connecting the table panels for movement between a coplaner extended condition and a superimposed collapsed condition.

8. A wheelchair according to claim 1 wherein the first hinge means comprise a channel extending along the arm, and the second hinge means comprise an elongate shaft engageable in the channel.

9. A wheelchair according to claim 8 wherein the shaft is rotatable in the channel and slideable therealong.

10. A wheelchair according to claim 1 wherein the arm is substantially circular in profile and the first hinge means comprise clamp means for clamping the first hinge means on the arm, the clamp means including first and second clamp components with respective arcuate faces engageable with opposite sides of the arm, and means for drawing the first and second clamp components together.

11. A wheelchair according to claim 10 wherein the arcuate face of the first clamp component comprises a plurality of arcuate sections with radii of curvature that increase from the center of the arcuate face to its edges.

12. A wheelchair according to claim 1 including an arm rest, the first hinge means including a flange extending across the arm and means for mounting the arm rest on the flange.

13. In combination, a wheelchair having a chair, at least one substantially horizontal arm and drive wheels on opposite sides of the chair, and a table assembly, the table assembly comprising:

first hinge means mounted on the arm and having first hinge pivot means comprising a channel extending along an outer side of the arm, the channel having a vertically elongate profile with spaced apart upper and lower bearing surfaces;

a table panel having opposite first and second faces and a mounting edge;

second hinge means including table panel mounting means secured to the table panel adjacent the mounting edge of the table panel, second hinge pivot means with a pivot axis spaced outwardly from the mounting edge and spaced from the second face of the table, the second pivot means comprising an elongate shaft rotatable in the channel, slideable along the channel and vertically moveable in the channel for selective engagement with the upper and lower bearing surfaces for movement of the table panel between a first use position in which the table panel extends across the arm with the first face of the table panel uppermost and the shaft engages the upper bearing means and a storage position in which the table panel is positioned substantially below the arm, laterally between the chair and the adjacent drive wheel and the shaft engages the lower bearing surface to support the table panel in the storage position;

first abutment means on the first and second hinge mean, engageable in the first use position to support the table panel in the first use position; and second abutment means on the first and second hinge means, engageable in a second use position of the table panel, in which the table panel projects substantially horizontally outwardly from the arm and the second hinge pivot means engages the upper bearing means for supporting the table panel in the second use position.

14. A wheelchair according to claim 13 including a slot along the channel for passage of the shaft therethrough whereby the second hinge means and the table panel may be removed from and replaced on the first hinge means.

15. A wheelchair according to claim 14 including resilient finger means projecting into the slot for inhibiting inadvertent release of the shaft from the channel.

16. A wheelchair according to claim 14 wherein the second abutment means comprise a portion of the second hinge means projecting into the slot in the second use position of the table panel.

* * * * *